US011425983B2

(12) United States Patent
Bruder

(10) Patent No.: US 11,425,983 B2
(45) Date of Patent: Aug. 30, 2022

(54) LIQUID DISPENSER

(71) Applicant: Aptar Radolfzell GmbH, Radolfzell (DE)

(72) Inventor: Thomas Bruder, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 161 days.

(21) Appl. No.: 16/632,447

(22) PCT Filed: Jun. 14, 2018

(86) PCT No.: PCT/EP2018/065888
§ 371 (c)(1),
(2) Date: Jan. 20, 2020

(87) PCT Pub. No.: WO2019/015893
PCT Pub. Date: Jan. 24, 2019

(65) Prior Publication Data

US 2021/0076798 A1 Mar. 18, 2021

(30) Foreign Application Priority Data

Jul. 21, 2017 (EP) ..... 17182583

(51) Int. Cl.
*A45D 34/04* (2006.01)
*B05B 11/02* (2006.01)
(Continued)

(52) U.S. Cl.
CPC ..... *A45D 34/042* (2013.01); *B05B 11/0035* (2013.01); *B05B 11/02* (2013.01); *B05B 11/046* (2013.01); *A45D 2200/1009* (2013.01)

(58) Field of Classification Search
CPC ..... A45D 34/042; A45D 40/262; A45D 2200/051; A45D 2200/054;
(Continued)

(56) References Cited

U.S. PATENT DOCUMENTS 3,256,894 A * 6/1966 Sherman ..... A46B 11/0055 401/176
3,825,021 A * 7/1974 Seidler ..... A45D 40/262 401/172
(Continued)

FOREIGN PATENT DOCUMENTS

CN 1842474 A 10/2006
CN 101484040 A 7/2009
(Continued)

OTHER PUBLICATIONS

DiDomenico Astin, "Finger force capabilty:measurementand prediction using anthropometric and myoelectric measures", Master of Science in Industrial and Systems Engineering, Dec. 16, 1999; (p. 24) (Year: 1999).*
(Continued)

*Primary Examiner* — Patrick M. Buechner
(74) *Attorney, Agent, or Firm* — Flynn Thiel, P.C.

(57) ABSTRACT

A liquid dispenser for cosmetic liquids having a liquid reservoir and an applicator. An outlet channel connects the reservoir to the applicator, the outlet channel being formed either valveless or with an outlet valve. The liquid dispenser has a pressure generating device which pressurizes liquid in the reservoir for conveyance through the outlet channel to the applicator. The pressure generating device has an air pumping device which feeds and an actuating pressure chamber. The actuating pressure chamber adjoins, and is separated from, the reservoir by a displaceable wall so that an overpressure in the actuating pressure chamber leads to an overpressure in the reservoir. The air pumping device has manual actuator, allowing air to be pumped into the actuating pressure chamber by the actuator, so that the overpressure in the actuating pressure chamber and in the reservoir
(Continued)

rises sufficiently to convey liquid from the reservoir to the applicator.

17 Claims, 4 Drawing Sheets

(51) Int. Cl.
*B05B 11/04* (2006.01)
*B05B 11/00* (2006.01)

(58) Field of Classification Search
CPC ..... A45D 2200/055; A45D 2200/056; A45D 2200/10; A45D 2200/1009; A45D 2200/1018; B05B 11/046; B05B 11/00412; B05B 11/00416; B05B 11/0062; B05B 11/007; B05B 11/3073; B05B 11/3052; B05B 11/304; B05B 11/3038; B05B 11/3035; B05B 11/3028; B05B 11/02; B05B 11/0072
See application file for complete search history.

(56) References Cited

U.S. PATENT DOCUMENTS 3,955,720 A 5/1976 Malone
4,147,284 A 4/1979 Mizzi
4,341,330 A 7/1982 Mascia et al.
5,865,350 A 2/1999 Losenno et al.
6,533,482 B1 * 3/2003 Byun ..... B05B 11/3015 401/180
6,945,723 B1 * 9/2005 Gueret ..... A45D 33/02 401/122
8,079,771 B2 * 12/2011 Ko ..... A46B 11/0065 401/188 R
8,297,480 B2 * 10/2012 Soon ..... B65D 83/0005 222/389
9,022,680 B1 * 5/2015 Lubyanitskiy ..... A46B 11/0086 401/188 R
9,642,438 B2 5/2017 Choi
10,285,488 B2 5/2019 Villarreal et al.
2003/0123919 A1 * 7/2003 Gueret ..... A45D 34/00 401/130
2004/0047676 A1 * 3/2004 Dumler ..... A45D 34/04 401/291
2007/0068967 A1 3/2007 Kee
2009/0092563 A1 * 4/2009 Allred ..... A61C 19/066 424/53
2009/0285622 A1 11/2009 Veasey et al.
2014/0076341 A1 * 3/2014 Byun ..... A45C 13/008 132/112
2015/0360014 A1 12/2015 Decaux et al.
2019/0022695 A1 * 1/2019 Zhang ..... B05C 17/00596

FOREIGN PATENT DOCUMENTS

CN 105077964 A 11/2015
CN 106488722 A 3/2017
CN 106659282 A 5/2017
EP 1249187 A1 10/2002

OTHER PUBLICATIONS

European Search Repod issued in corresponding EP 17 18 2583 with English translation of categories of cited documents, dated Feb. 5, 2018 (8 pages).
International Search Report issued in corresponding International Application No. PCT/EP2018/065888 with English translation dated Jul. 6, 2018 (5 pages).
Written Opinion of International Searching Authority issued in corresponding International Application No. PCT/EP2018/065888 dated Jul. 6, 2018 (6 pages).
Chinese Office Action issued in corresponding Chinese Application No. 201880049067.0 dated Nov. 19, 2021 (8 pages).

* cited by examiner

LIQUID DISPENSER

FIELD OF APPLICATION AND PRIOR ART

The invention relates to a liquid dispenser for discharging liquids, in particular a liquid dispenser for discharging cosmetic liquids.

Liquid dispensers of the generic type have a reservoir for storing the liquid before discharge and an applicator, to which the liquid can be conveyed for the purpose of discharging from the reservoir. In order to build up the pressure required for this, a pressure generating device forms part of liquid dispensers of the generic type.

A typical pressure generating device is in this case a liquid pump, usually in the manner of a plunger pump or bellows pump, by which a partial amount of the liquid is sucked into a pump chamber as part of a return stroke movement and from there is pumped to the applicator as part of a stroke movement.

A pressure generating device of a fundamentally different kind in dispensers of the generic type may take the form of a pressure accumulator, which puts the reservoir as a whole under pressure. Such liquid dispensers are commonly used in particular for deodorant. The energy stored in the dispenser in the form of compressed air or in the form of a propellant gas is responsible here for pressurizing the reservoir, so that a discharge can be initiated by an actuator controlling a switching valve.

A special version of this is that of liquid dispensers with pressure generating devices in the case of which the compressed air is not already introduced into the liquid dispenser in the course of its production and filling, but is only introduced by shaking or manual pumping by the end user. Such a dispenser is known for example from U.S. Pat. Nos. 3,955,720 A, 4,147,284 A, and 5,865,350 A. In the case of all the liquid dispensers disclosed in these documents, the actuator is provided for controlling a switching valve, which, after building up the required discharge pressure, discharges the liquid pressurized in this way out of the reservoir by way of the applicator.

Problem and Solution

The problem addressed by the invention is that of developing a liquid dispenser to the extent that it has an advantageous configuration of a pressure generating device.

Proposed for this purpose is a liquid dispenser for discharging liquids, in particular cosmetic liquids for application on the skin, which has a reservoir for storing liquid before discharge and an applicator through which the liquid can be delivered into a surrounding area.

The reservoir and the applicator are connected by way of an outlet channel. This is intended preferably to offer little resistance to the liquid pressurized in the reservoir. Conceivable therefore is a design in which the outlet channel is configured as a valveless outlet channel, which creates a permanent connection between the reservoir and the likewise valveless applicator, so that there is no liquid-tight seal between the reservoir and the applicator itself. The design that is preferred over this, however, provides that the liquid dispenser has a liquid channel with a pressure-dependently opening liquid outlet valve, which opens when there is a minimum opening overpressure sufficient for opening the liquid outlet valve.

In order to build up the pressure required for discharge, the liquid dispenser has a pressure generating device, by means of which liquid in the reservoir can be pressurized, in order to be able to be conveyed through the valveless outlet channel or outlet channel provided with a pressure-dependently opening valve to the applicator.

In this case, the pressure generating device has an air pumping device and an actuating pressure chamber fed by it. The actuating pressure chamber adjoins the reservoir and is separated from the reservoir by a displaceable wall, so that an overpressure in the actuating pressure chamber leads to an overpressure in the reservoir. In spite of its displaceability that makes the transmission of pressure possible, the wall however prevents liquid from being able to pass from the reservoir into the actuating pressure chamber. Usually and preferably, the area of the wall to which pressure is applied is identical in the reservoir and in the actuating pressure chamber, so that identical pressures are also established. The wall may however also have pressure application areas of different sizes on both sides, so that it acts as a pressure converter.

The air pumping device of the pressure generating device has an actuator for the manual actuation of a pump, allowing air to be pumped into the actuating pressure chamber by means of the actuator, so that in this way the overpressure in the actuating pressure chamber and in the reservoir rises sufficiently to convey liquid from the reservoir to the applicator.

In the case of a liquid dispenser according to the invention, it is consequently provided that the actuation for achieving a discharge of liquid is performed by way of the actuator of the air pumping device, which increases the amount of air in the actuating pressure chamber, and consequently also brings about an increase in pressure in the entire liquid reservoir. This increase in pressure in the liquid reservoir then has the effect that, after the pressure has risen sufficiently far, the liquid is conveyed in the direction of the applicator.

The discharge is in this case brought about directly by way of the actuator and its effect on the pressure in the actuating pressure chamber. Further actuation by the user in the manner of opening an outlet valve is not envisaged. For this, the actuator acts on the air pumping device, it being provided in particular for forcing air into the actuating pressure chamber by being repeatedly pressed down and let go.

The air pumping device preferably has a pump chamber, which is temporarily connected to a surrounding area by a pressure-dependently opening air inlet valve and is temporarily connected to the actuating pressure chamber by a pressure-dependently opening air outlet valve. When the actuator is actuated as intended, by being pressed down or in some other way, the air inlet valve is closed in the direction of the surrounding area and the air outlet valve is opened in the direction of the actuating pressure chamber. When it is let go, the air outlet valve closes, the air inlet valve opens and air flows from the surrounding area into the pump chamber.

The pump chamber of the air pumping device is preferably formed by a bellows, in particular by a bellows that is open on both sides. A bellows represents a simple and advantageous method for realizing the pump chamber. In addition, on account of the elastically deformable material, it is suitable for providing an integrally attached valve area for the air inlet valve or the air outlet valve.

In the case of a particularly preferred design, an end of the bellows that is assigned to the actuator is movable with respect to the actuator and has an inlet opening, which is closed when the actuator lies against the bellows, in particular by a conical closing portion on the actuator. This design allows the inlet valve to be realized just by using components that are present anyway in the case of a bellows design.

When an elastically deformable bellows is used, it can also be used to bring about a return force required for returning the actuator. However, it is advantageous in the case of a design with or without bellows if the air pumping device has a separate return spring, in particular preferably in the form of a helical spring, by which the actuator is urged in the direction of a starting position. This allows a rapid return travel of the actuator to be brought about, which is advantageous in particular whenever the liquid dispenser is designed in such a way that it requires a number of actuations of the actuating button to build up the pressure in the reservoir that is required for the discharge. In the case of a design with a bellows and movability of the actuator with respect to the end of the bellows facing it, the return spring serves the purpose of allowing a more rapid return of the actuator with respect to the bellows, and thus opening of the air inlet valve.

How much the pressure has to rise for this conveyance of liquid to occur depends on the configuration of the outlet channel and to a lesser extent also on the alignment of the dispenser. In principle, it is regarded as advantageous if it only takes a few air pumping strokes by way of the actuator to discharge liquid, ideally only one or two air pumping strokes.

In order to achieve this, it is advantageous if the actuating pressure chamber is sealed off sufficiently completely with respect to the surrounding area and the air inlet valve closes with a sufficiently tight seal to maintain a pressure that has once been introduced into the actuating pressure chamber over a lengthy period of time of at least several days.

It is likewise advantageous for the purpose of rapidly achieving a discharge if, in the case of a design with a liquid outlet valve in the outlet channel, it already opens when there is a small overpressure, for example of at most 10 mbar or at most of 40 mbar. Accordingly, it also does not require a very high pressure in the actuating pressure chamber, which in turn is helpful to be able to bring about a discharge with only a few actuations, in particular 1 or 2, independently of the filling state of the reservoir and the already achieved volume and pressure in the actuating pressure chamber.

In spite of the preferred small opening pressure, it is regarded as advantageous that an outlet valve is provided, because this prevents the discharge from taking place without the pressure in the reservoir being increased or when there is only a very slight rise in pressure. Thus, the valve is preferably designed in such a way that the valve remains closed in an inverted position, with the outlet valve facing downward, and/or when the liquid dispenser is handled normally during transport.

In principle, it is however also possible to do without the liquid outlet valve entirely, so that the outlet channel from the reservoir to the applicator is always open, in the case of such a design even the applicator itself not having a valve. With such a design, there is admittedly the risk in principle of the dispenser leaking in an inverted position. However, this risk is acceptable in an individual case, especially since with liquids of a relatively high viscosity and/or with a narrow outlet channel the tendency for the liquid to leak out is low.

To avoid leaking out of liquid from the reservoir, a liquid throttle may be provided for this in the outlet channel, preferably with a minimum clear cross section of at most 1 $mm^2$. It is in this case advantageous if the liquid throttle has a coupling portion of at least 2 mm in length, within which the clear cross section is at most the aforementioned 1 $mm^2$.

It is also possible that a plurality of discharge channels, which lead to a common applicator, are provided, each of the discharge channels then preferably having a throttling portion, the minimum clear cross section of which is at most 1 $mm^2$ and/or which has a throttling portion of at least 2 mm in length. In principle, the optimum dimensioning of the throttling portion or the throttling effect of the outlet channel depends on the reservoir and its filling. Preferably, the liquid dispenser is configured and its valveless outlet channel is dimensioned in such a way that, in an inverted position of the dispenser with a full reservoir, the flow resistance provided by the outlet channel is so great that the hydrostatic pressure of the liquid in the reservoir is not enough on its own to overcome the resistance.

In order that, in the event of liquid unwantedly reaching the applicator, as far as possible it does not escape in an uncontrolled manner, the liquid dispenser preferably has a cap, which can be placed removably and replaceably onto a base of the liquid dispenser. This cap isolates liquid-carrying parts of the applicator from its surrounding area.

It is of particular advantage in this case if the isolation takes place in a liquid-tight and preferably also gas-tight manner. A gas-tight configuration has the effect that even an unusually low ambient pressure, for example in the context of transport by aircraft, does not suck liquid out of the reservoir into the applicator as a result of the small overpressure required for discharge.

Two types of construction have proven to be advantageous for the configuration of the displaceable wall. In the case of a first variant, the reservoir and the actuating pressure chamber are provided within an at least partly cylindrical housing part. The displaceable wall in this case takes the form of an intrinsically rigid separating plunger, which is provided in a slidingly movable manner in the housing part, lying in a sealing manner against a cylinder wall of the housing part.

The separating plunger slides on the inner side of the cylinder wall, it being displaced in the course of the progressive emptying of the reservoir in the manner of a drag plunger. Unlike a drag plunger, this is however not the consequence of an emptying of the reservoir, but instead the cause of the emptying. With the assumption of frictionless sliding of the separating piston and a uniform cross section of the reservoir and the actuating pressure chamber, the same pressure is established in the liquid as in the actuating pressure chamber.

If the separating plunger is intended at the same time to bring about a pressure conversion, it should be provided that its pressure application areas provided on both sides are of different sizes. In this case, the housing part needs cylinder portions of two different cross-sectional areas.

An alternative design provides that the displaceable wall takes the form of an intrinsically deformable and preferably pliable film wall. It may be in particular a bag wall of a bag which forms the reservoir or the actuating pressure chamber.

Such a film wall, in particular in the form of a thin plastic film or a composite film comprising multiple layers of material, represents a very simple way of being able to exert the pressure of the actuating pressure chamber also on the liquid in the reservoir. Bags are similarly known from so-called airless dispensers and can be used for this. The bag is located in a region that is surrounded by rigid walls and separates the bag wall into two sub-regions, to be specific, the reservoir and the actuating pressure chamber. In order to simplify complete emptying, the reservoir is preferably provided within the bag and the actuating pressure chamber is arranged in a surrounding manner between the outer side of the bag and the inner wall of an outer housing. In principle, however, the opposite arrangement is also possible.

A dispenser according to the invention may in principle be intended for very different application techniques. Thus, with a suitable applicator, the liquid may be discharged in the form of a liquid stream or else in the form of drops. The applicator has in this case a discharge opening through which the liquid passes into a surrounding area. Also possible is a design in which the liquid dispenser is formed in the manner of a crucible, in the case of which liquid is conveyed by way of the air pumping device from the reservoir into a removal region, from which the liquid can be removed with fingers, in particular in the manner of a gel or a lotion.

Depending on the configuration of the outlet valve or the valveless outlet channel, a dispenser according to the invention displays particular discharging characteristics: the liquid can be discharged with comparatively low pressure and over a lengthy period of time. It can be advantageously used in various fields of application.

Thus, one particular design of the applicator provides that the applicator has an external application element provided for liquid take-up, in particular in the manner of a porous application element or a brush. This has a take-up side for taking up the liquid supplied from the discharge channel and a delivery side for delivering the liquid to a target surface.

An external application element for liquid take-up is understood as meaning an application element that has a complex structure for the intermediate storage of liquid. Such a complex structure may be formed by the bristles of a brush, such as a horsehair brush or a brush with porous bristles, which takes up liquid such as make-up liquid, so that it can subsequently be delivered in a well-apportioned manner on the skin. Such a complex structure is also achieved in particular by a porous element in the manner of a three-dimensional and substantially dimensionally stable body, which is permeated by a mesh-like structure comprising chambers, pores and passages, so that it provides a storage effect for the liquid introduced, but can also deliver it in an apportioned manner on the skin, in particular under the control of the pressing pressure. The porous element may be formed in the manner of a deformable sponge or a deformable block of porous plastic, so that, by pressing on the skin, liquid is delivered at a greater rate. However, designs in which the forces that usually occur during the discharging of cosmetics do not bring about any appreciable deformation of the application element, for example by the application element being formed from a rigid porous plastic or by a porous ceramic or some other porous material being used, are also expedient and are covered by the invention.

If such a rigid porous material is used, it may for example be a sponge of a material that is offered under the trade name POREX. The sponge or the application element may then have a Shore A hardness of at least 40, preferably of at least 60, in particular preferably of at least 80.

The external application element is arranged at the end of the outlet channel, so that the liquid supplied thereby is taken up in the complex structure of the element and is distributed there in the pores and cavities. The liquid passes through the pores or along the bristles to the delivery side, which is preferably formed in the manner of an application area which can be passed over the skin, for example under light pressure, in order to deliver liquid uniformly there.

In particular in the context of a liquid dispenser with such an application element, the pressure generating device provided according to the invention with an air pump and an actuating pressure chamber is of great advantage. The air-pressure-induced conveyance of liquid into the application element preferably takes place slowly, so that the liquid can be distributed uniformly in the external application element. The greater the saturation of the application element, the greater also the resistance that opposes the inflow of further liquid, so that it can possibly also reduce or prevent the inflow of liquid for a short time even though the pressure in the reservoir is in fact sufficient to convey the liquid through the liquid channel.

The pressure generating device provided according to the invention with an air pump and an actuating pressure chamber is therefore much better suited for feeding the application element than conveyance by means of a plunger pump or the like, because, when there is excessive pressure, as would have to be feared in the case of the latter, the liquid can be forced directly to the delivery side and unwantedly escape there without spreading out homogeneously in the porous element.

The liquid dispenser is preferably formed in a pen-like or elongated manner, having a, preferably slender, outer housing aligned in a main direction of extent, and the applicator and the actuator being arranged on ends of the outer housing that are opposite from one another. Thus, an uninterrupted discharge of the liquid can be achieved by the applicator side being passed over the skin, while at the opposite end the actuator is actuated from time to time in order to feed fresh liquid into the application element.

It has been found to be advantageous in this case for convenient handling if the actuator is formed as an actuating button that can be pressed down translationally in the main direction of extent in the direction of the applicator. This allows advantageous handling with one hand, by which the applicator is pressed against the skin, and can also be actuated at the opposite end in the same direction. This avoids unwanted changing of the alignment of the liquid dispenser due to the actuation.

In particular in the case of a pen-like liquid dispenser, an advantageous construction is one in which the liquid dispenser has a main housing component with an interior space in which the reservoir and the actuating pressure chamber are arranged. The air pumping device in this case comprises a separating wall, on which a sealing area of an air outlet valve is provided. This separating wall is provided as an integral part of the main housing component. The said type of construction is technically simple in terms of production on account of the low number of parts and allows elements of the air pumping device to be securely supported on the separating wall, for example a pump bellows and/or a return spring. The separating wall is also suitable for attaching a movable or deformable valve part of the air outlet valve.

An advantageous way of configuring a liquid outlet valve for the liquid dispenser as described provides that the liquid outlet valve has a slit valve component of elastic material, which opens in a deformed state. Such valves that are created by a cut or slit introduced in the elastic material are very well suited for allowing a reproducible opening behavior even with quite low pressures. The possible configurations include a flat valve, in the case of which a planar element is slit perpendicularly thereto, and a dome valve comprising a dome in which the slit is provided.

As already described, the dispenser is advantageous in particular for cosmetic applications and is accordingly filled with such a liquid in the state in which it is delivered to the final customer. Make-up liquids, in particular with a proportion of solid matter, or a cosmetic gel or a cosmetic lotion may be concerned.

However, other fields of application are also possible. In particular in the configuration with a porous application element, the liquid dispenser is suitable for all fields of application in which liquid is to be distributed uniformly on surfaces by means of a kind of sponge. This also includes for example insect repellents for application on the skin or care products for applying for example to shoes.

BRIEF DESCRIPTION OF THE DRAWINGS

Further advantages and aspects of the invention emerge from the claims and from the following description of preferred exemplary embodiments of the invention, which are explained below on the basis of the figures.

DETAILED DESCRIPTION OF THE EXEMPLARY EMBODIMENTS

Figure 1:
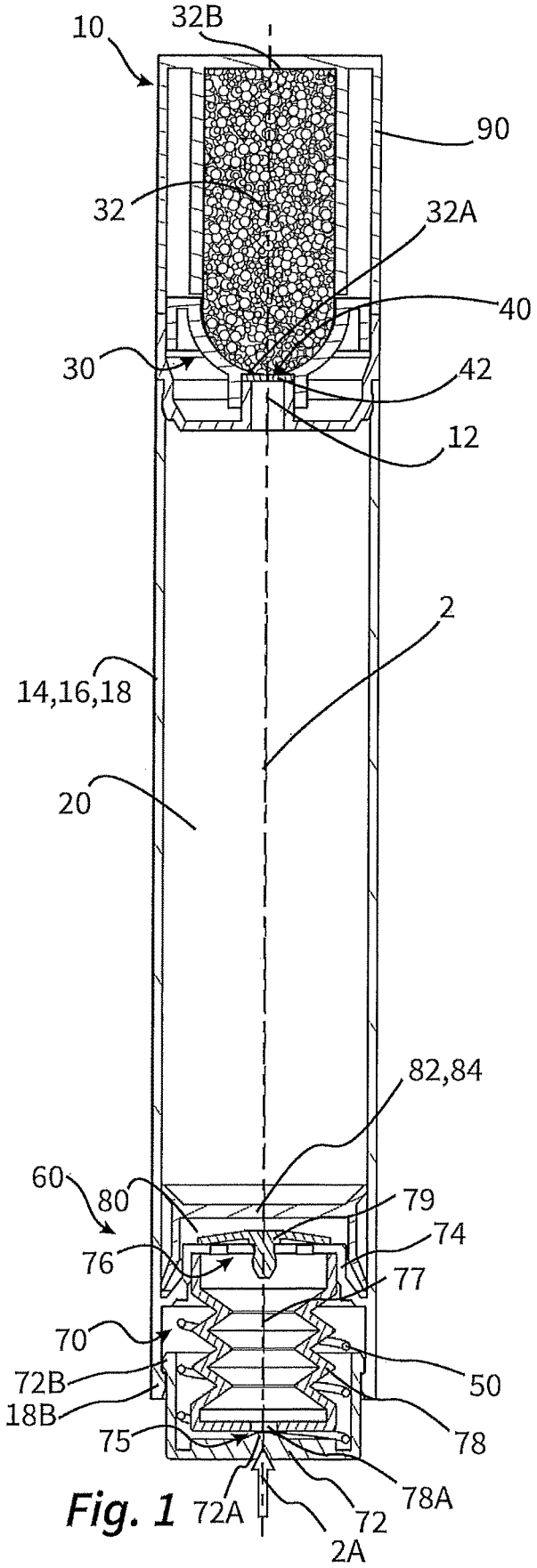
FIGS. 1 and 2 show a first configuration of a dispenser according to the invention in a sectional representation and an exploded representation.
Figure 2:
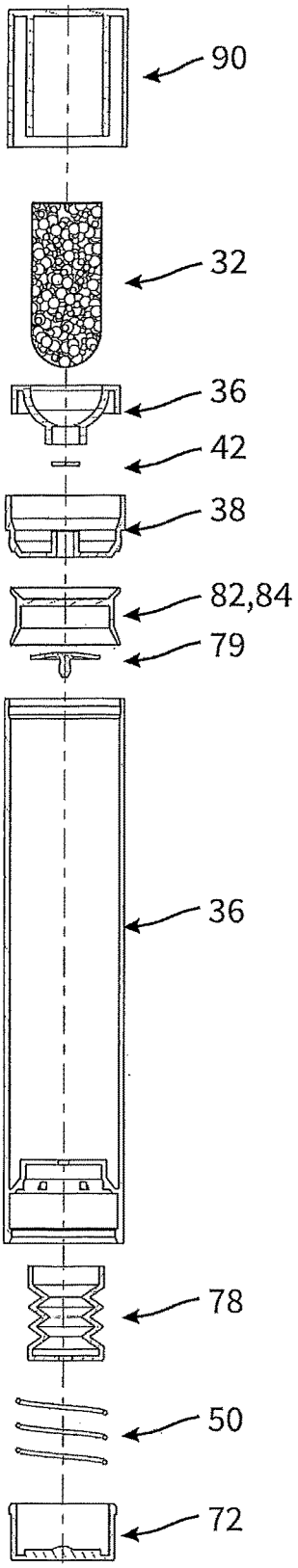

FIGS. 1 and 2 show a first embodiment of a liquid dispenser 10 according to the invention in the assembled state and as an exploded representation.

This liquid dispenser 10 has a discharge device and, placed on it, a cap 90. The discharge device itself has a substantially cylindrical outer housing 16, on the upper end of which, shown in FIGS. 1 and 2, an applicator 30 is attached. Provided on the opposite side of the outer housing 16 is a pressure generating device 60, which is made up of an air pumping device 70 and an actuating pressure chamber 80.

The actuating pressure chamber 80 and a reservoir 20 arranged above the actuating pressure chamber 80 are of a variable size. They are separated from one another by a separating plunger 84, which forms a wall 82 and in the course of the progressive emptying of the reservoir 20 is displaced upward with respect to the perspective of FIGS. 1 and 2, so that the reservoir 20 is reduced in size and the actuating pressure chamber 80 is increased in size.

The applicator 30 has as the main component an application element 32, which forms the distal end of the discharge device. The application element 32 is formed as an elastic, sponge-like porous body and is clamped or adhesively fixed in a recess provided for it in a housing of the applicator, consisting of two housing parts 36, 38. The lower of the housing parts, the housing part 38, defines in its middle an outlet channel 12. This ends at a liquid outlet valve 40, which has a slit valve component 42 of an elastic material.

The use as intended of the liquid dispenser 10 provides that the application element 32, or the delivery side 32, thereof, is used to apply a make-up liquid on the skin of a user. For this, the application element 32 must be impregnated with liquid from the reservoir 20. On account of the liquid outlet valve 40, for this pressure must be produced in the reservoir 20. The already mentioned pressure generating device 60 is provided for this. The pressure generating device 60 is intended for the purpose that, by forcing air into the actuating pressure chamber 80, a pressure of approximately equal magnitude is caused in the liquid within the reservoir 20. Provided for forcing air into the actuating pressure chamber 80 is an actuator 72, which can be depressed in the direction of the arrow 2A, in order in this way to compress a pump chamber 77 within a bellows 78, so that the air flows out of the pump chamber 77 through an air outlet valve 76, which opens when there is overpressure and is provided as a shield valve with a shield 79, into the actuating pressure chamber 80. For this purpose, the bellows 78 is formed so as to be open at its upper end. At the lower end, by contrast, an end wall which is interrupted by a central aperture 78A is provided on the bellows 78. At this lower end, the actuator 72 is not fixedly connected to the bellows 78, but is movable with respect to it, so that an air inlet valve 75 formed by this aperture 78A and an elevation 72A on the inner side of the actuator 72 can open and close.

In order to ensure a rapid return stroke, and consequently opening of the air inlet valve 75, also provided is a spring 50, which is formed as a helical spring and constantly applies a force to the actuator 72 in the direction of its lower end position as in FIG. 1.

Figures 3A, 3B, 3C, 3D:
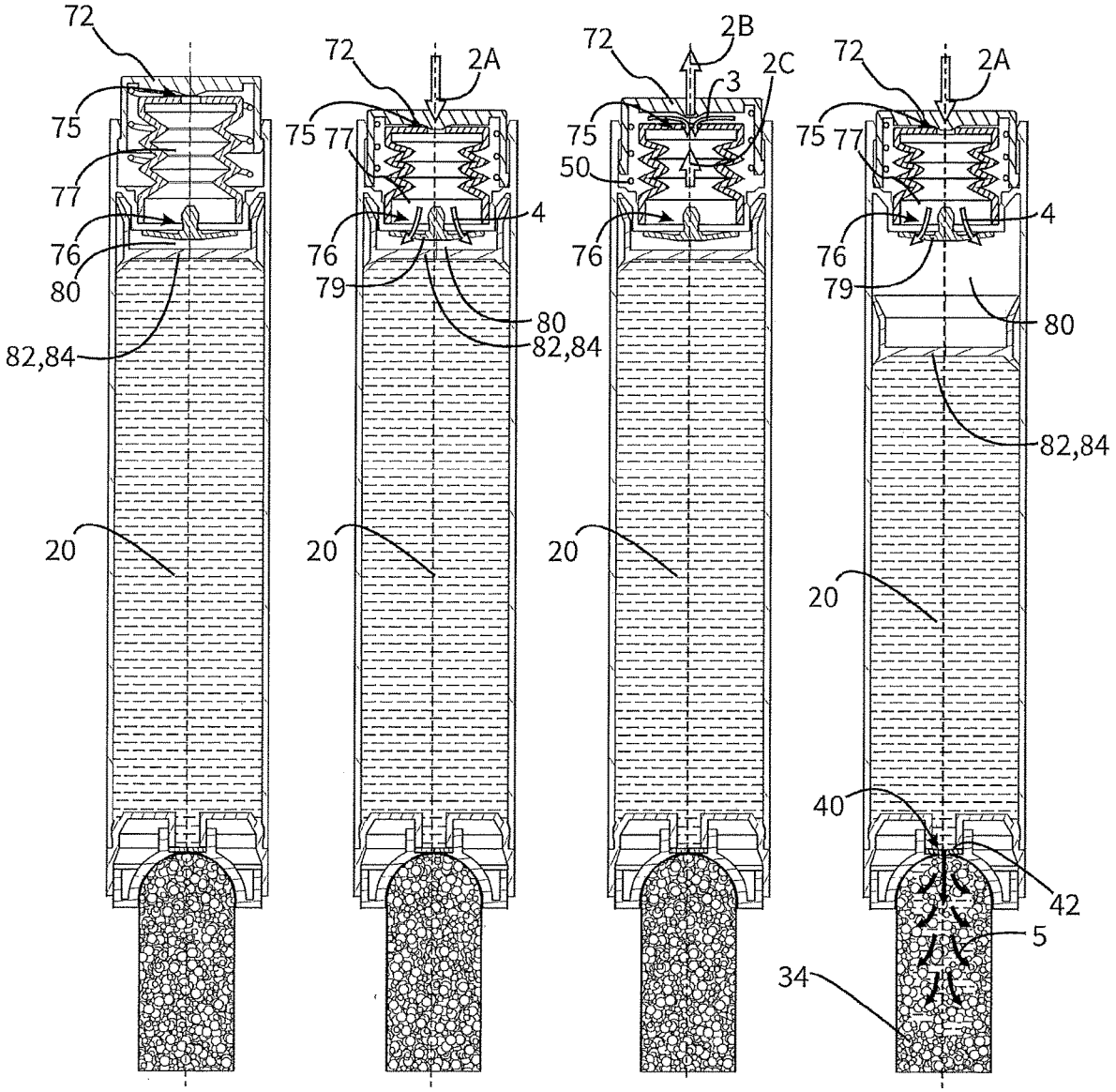
FIGS. 3A to 3D illustrate the operating principle of the liquid dispenser from FIGS. 1 and 2.

FIGS. 3A to 3C illustrate the operating principle. Starting from the as-delivered state of FIG. 3A with a completely filled reservoir 20, the actuator is pressed down, as FIG. 3B indicates by the arrow 2A. That leads initially to a closing of the air inlet valve 75 and to an opening of the air outlet valve 76. The air flowing into the actuating pressure chamber 80, which is illustrated by the arrows 4, leads to an increased air pressure there. The freely movable separating plunger 84 causes the liquid in the reservoir 20 to be subjected to the same pressure, while the overpressure in the reservoir 20 that has been produced by the so far single actuation is not yet sufficient to open the liquid outlet valve 40.

If the actuator 72 is let go, it is rapidly urged back into its starting position by the spring 50, as illustrated by FIG. 3C and the arrow 2B there. The air outlet valve 76 resumes a closed state, which is caused by the shaping of the valve shield 79. The air inlet valve 75 opens, since the bellows 78 does not return in the direction of the arrow 2C at the same rate as the actuator 72. While the increased air pressure in the actuating pressure chamber 80 is maintained, at the end of the first actuating action, the volume of the pump chamber 77 is at a maximum again and the air pressure corresponds to the ambient pressure. With the second actuation, corresponding to FIG. 3D, the pressure in the actuating pressure chamber 80 is increased once again. This then leads to a sufficiently high pressure to open the liquid outlet valve 40 by opening of the slit in the valve component 42 and discharging liquid in a way corresponding to the liquid displaced by the separating plunger 84. The liquid is thereby discharged under only slight overpressure, so that it can be distributed very homogeneously within the application element 32. The arrows 5 illustrate this.

If the pressure in the reservoir 20 falls below the opening pressure of the liquid outlet valve 40, the liquid outlet valve 40 closes again. The slight overpressure that persists up to this point in time in the reservoir 20 and the actuating pressure chamber 80 is, however, maintained. If a renewed actuation is performed at a later point in time by way of the actuator 72, this already leads with the first actuation to a sufficient overpressure to in turn open the liquid outlet valve 40, and consequently to feed the application element 32 once again with liquid.

Figure 4:
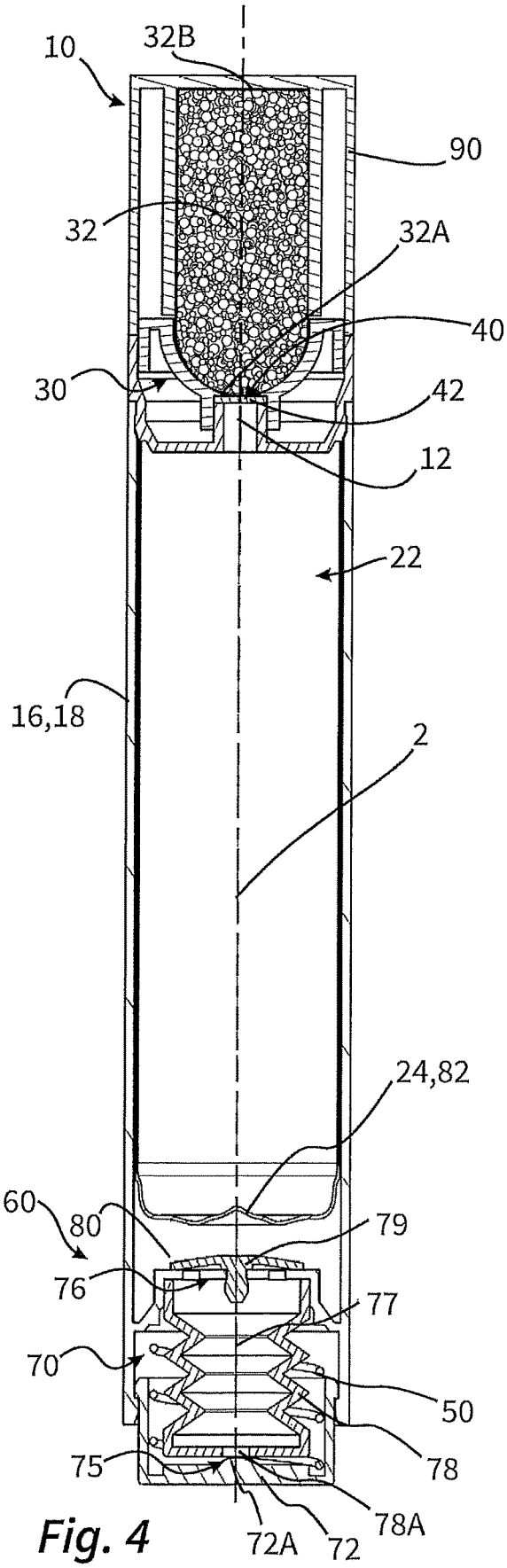
FIGS. 4 and 5 show a second configuration of a dispenser according to the invention in a sectional representation and an exploded representation.
Figure 5:
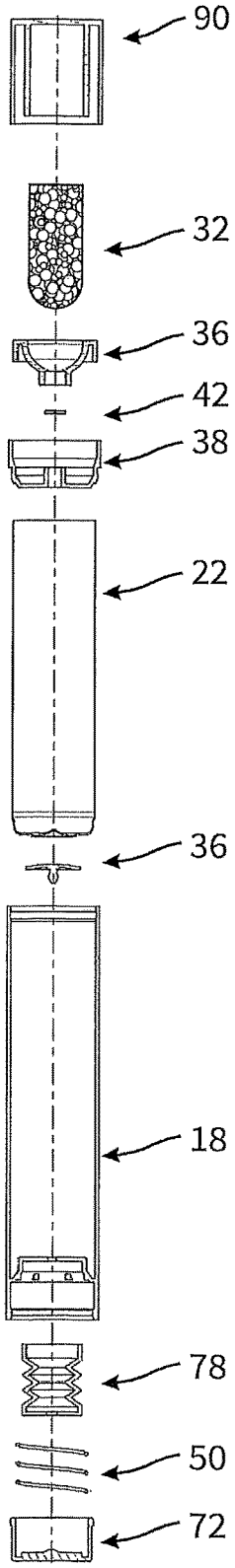

The configuration of FIGS. 4 and 5 differs from the previous exemplary embodiment only by the type of wall 82. In the case of the design according to FIGS. 4 and 5, a dimensionally flexible and pliable bag 22 is provided, the film wall 24 of which forms the wall 82 between the actuating pressure chamber 80 and the reservoir 20.

Figure 6:
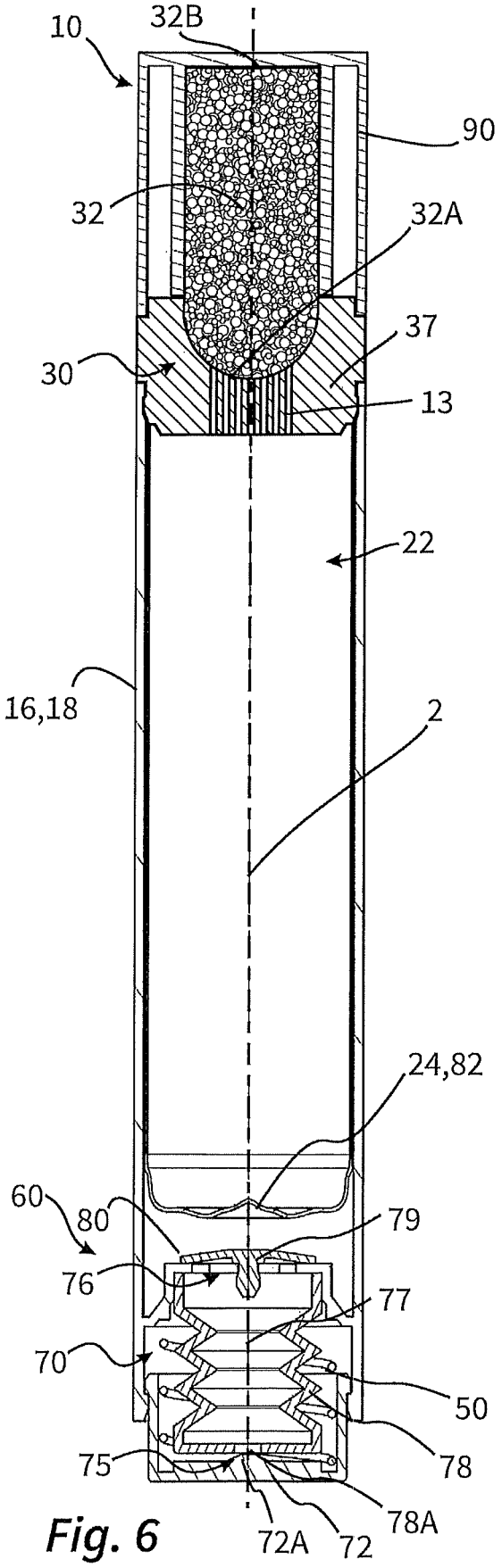
FIG. 6 shows a third configuration of a dispenser according to the invention in a sectional representation.

The configuration of FIG. 6 differs from the previous configurations in that no liquid outlet valve 40 is provided. The two housing parts 36, 38 are formed as a unitary housing part 37, which is perforated by a plurality of valveless outlet channels 13.

The operating principle is fundamentally identical to that of the previous configurations. However, the pressure required for the conveyance of liquid into the application element 32 is not caused by an outlet valve, but by the comparatively narrow and throttle-like shape of the outlet channels 13.

However, the risk of escape is in principle greater in the case of such a design, and so it is not preferred. The risk can however be reduced by a liquid-tight configuration of the cap 90.

The invention claimed is:

1. A liquid dispenser for discharging liquids, with the following features:

the liquid dispenser has a reservoir for storing liquid before discharge;

the liquid dispenser has an applicator, through which the liquid can be delivered into a surrounding area;

the liquid dispenser has an outlet channel which connects the reservoir to the applicator, the outlet channel being configured as a valveless outlet channel which creates a permanent connection between the reservoir and the applicator, and the applicator is also valveless;

the liquid dispenser has a pressure generating device, by which liquid in the reservoir can be pressurized in order to be able to be conveyed through the outlet channel to the applicator;

the pressure generating device has an air pumping device and an actuating pressure chamber fed by the air pumping device;

the actuating pressure chamber adjoins the reservoir and is separated from the reservoir by a displaceable wall so that an overpressure in the actuating pressure chamber leads to an overpressure in the reservoir;

the air pumping device has an actuator for manual actuation, allowing air to be pumped into the actuating pressure chamber by the actuator so that the overpressure in the actuating pressure chamber and in the reservoir rises sufficiently to convey liquid from the reservoir to the applicator; and to avoid leaking out of liquid from the reservoir, the valveless outlet channel has a liquid throttle.

2. The liquid dispenser as claimed in claim 1, with one of the following additional features:

the liquid throttle has a throttling portion of at least 2 mm in length, and a clear cross section of the throttling portion is at most 1 $mm^2$; or a plurality of discharge channels which lead to the applicator are provided, each of the discharge channels having a throttling portion, and a minimum clear cross section of each of the throttling portions is at most 1 $mm^2$.

3. A liquid dispenser for discharging liquids, said liquid dispenser comprising:

a reservoir configured to store liquid prior to discharge from said liquid dispenser;

an applicator for delivering liquid into a surrounding area, said applicator comprising a porous application element for liquid take-up, said porous application element having an externally-located liquid-delivering side for delivering liquid to a target surface and a liquid take-up side; and an outlet channel connecting said reservoir to said applicator, said liquid take-up side of said porous application element being disposed to take up liquid supplied from said outlet channel, wherein:

said outlet channel is configured as a valveless outlet channel creating a permanent connection between said reservoir and said applicator, and said applicator is also valveless; or said liquid dispenser includes a liquid outlet valve dependent on pressure for opening, said liquid outlet valve opening when there exists a sufficient minimum opening overpressure;

said liquid dispenser further including a pressure generating device configured to pressurize liquid in said reservoir such that the liquid is conveyed through said outlet channel to said applicator, said pressure generating device having an air pumping device and an actuating pressure chamber fed by said air pumping device, said actuating pressure chamber adjoining said reservoir and being separated therefrom by a displaceable wall such that an overpressure in said actuating pressure chamber leads to an overpressure in said reservoir, said air pumping device having an actuator for manual actuation, said actuator allowing air to be pumped into said actuating pressure chamber such that the overpressure in said actuating pressure chamber and in said reservoir rises sufficiently to convey liquid from said reservoir to said applicator.

4. The liquid dispenser as claimed in claim 3, further comprising an at least partially cylindrical housing part and said reservoir and said actuating pressure chamber are disposed within said housing part, said displaceable wall comprising a rigid separating plunger disposed in a slidingly movable manner in said housing part and lying in a sealing manner against a wall of said housing part.

5. The liquid dispenser as claimed in claim 3, further including a main housing component defining an interior space, said reservoir and said actuating pressure chamber being disposed in said interior space, said air pumping device comprises a separating wall and a sealing area of an air outlet valve being provided on said separating wall, said separating wall being formed integrally with said main housing component.

6. The liquid dispenser as claimed in claim 3, wherein said liquid dispenser comprises said liquid outlet valve, said liquid outlet valve comprising a slit valve component of a deformable elastic material, said slit valve opening when deformed.

7. The liquid dispenser as claimed in claim 3, wherein said liquid dispenser comprises said liquid outlet valve and a minimum opening overpressure, needed to open said liquid outlet valve, in said reservoir with respect to the surrounding area is at least 10 mbar.

8. The liquid dispenser as claimed in claim 3, wherein said reservoir is filled with a cosmetic liquid.

9. The liquid dispenser as claimed in claim 3, further comprising an outer housing aligned along a main direction of extent, said outer housing having spaced-apart opposite ends, said applicator being disposed at one of said ends of said housing and said actuator being disposed at the other of said ends of said housing, said liquid dispenser further comprising a cap removably disposed on said one end of said housing to cover said porous application element and isolate said porous application element from the surrounding area.

10. The liquid dispenser as claimed in claim 3, wherein said air pumping device comprises a bellows forming a pump chamber, said pump chamber being temporarily connected to the surrounding area by an air inlet valve dependent on pressure for opening and temporarily connected to said actuating pressure chamber by an air outlet valve dependent on pressure for opening, said bellows being open on opposite sides thereof, one side of said bellows being disposed adjacent to said actuator and having an opening, said bellows being movable relative to said actuator and said opening of said bellows being closed by said actuator when said actuator lies against said one side, and/or said air pumping device comprises a return spring disposed to urge said actuator in a direction of a starting position.

11. The liquid dispenser as claimed in claim 3, wherein said displaceable wall comprises a deformable film wall.

12. The liquid dispenser as claimed in claim 11, wherein said reservoir or said actuating pressure chamber comprises a bag with a bag wall, said bag wall forming said deformable film wall.

13. The liquid dispenser as claimed in claim 3, further including an outer housing aligned along a main direction of extent, said outer housing having spaced-apart opposite ends, said applicator being disposed at one of said ends of said outer housing and said actuator being disposed at the other of said ends of said outer housing, said liquid-delivering side of said porous application element comprising a liquid-delivering application area disposed externally of said outer housing and configured to dispense liquid to the target surface and said liquid take-up side comprising a liquid take-up area disposed to take up liquid supplied from said outlet channel, said liquid-delivering application area and said actuator facing in opposite directions from one another.

14. The liquid dispenser as claimed in claim 13, wherein said actuator comprises an actuating button mounted to said outer housing for movement relative thereto in a direction corresponding to said main direction of extent of said outer housing, said actuating button being pressable inwardly by a user along the main direction of extent and in a direction towards said applicator to dispense liquid.

15. The liquid dispenser as claimed claim 13, wherein said liquid-delivering application area of said porous application element is disposed and configured to dispense liquid to the target surface at least in a direction along a longitudinal axis of said outer housing.

16. The liquid dispenser as claimed in claim 13, wherein said porous application element has a terminal proximal end mounted to a distal end of said housing and a distal end defining said liquid-delivering application area, and said outlet channel has a distal end disposed immediately adjacent said terminal proximal end of said porous application element, said outlet channel being disposed and configured to dispense liquid into said terminal proximal end of said porous application element.

17. The liquid dispenser as claimed in claim 16, wherein said outlet channel is linear between said reservoir and said terminal proximal end of said porous application element.

* * * * *